US010263322B2

(12) United States Patent
Park

(10) Patent No.: US 10,263,322 B2
(45) Date of Patent: Apr. 16, 2019

(54) VEHICLE ANTENNA

(71) Applicant: LG INNOTEK CO., LTD., Seoul (KR)

(72) Inventor: Young Hun Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 15/567,315

(22) PCT Filed: Apr. 7, 2016

(86) PCT No.: PCT/KR2016/003627
§ 371 (c)(1),
(2) Date: Oct. 17, 2017

(87) PCT Pub. No.: WO2016/171415
PCT Pub. Date: Oct. 27, 2016

(65) Prior Publication Data

US 2018/0108981 A1 Apr. 19, 2018

(30) Foreign Application Priority Data

Apr. 24, 2015 (KR) ..... 10-2015-0057872

(51) Int. Cl.
*H01Q 1/32* (2006.01)
*H01Q 1/46* (2006.01)
(Continued)

(52) U.S. Cl.
CPC ..... *H01Q 1/3275* (2013.01); *H01Q 1/46* (2013.01); *H01Q 1/52* (2013.01); *H01Q 9/42* (2013.01);
(Continued)

(58) Field of Classification Search
CPC .... H01Q 1/085; H01Q 1/1207; H01Q 1/3275; H01Q 1/46; H01Q 1/52; H01Q 1/32; H01Q 21/24; H01Q 5/371; H01Q 9/42
See application file for complete search history.

(56) References Cited

U.S. PATENT DOCUMENTS 3,120,640 A * 2/1964 Midlock ..... H01Q 1/247 342/175
4,864,320 A * 9/1989 Munson ..... H01Q 19/06 343/833
(Continued)

FOREIGN PATENT DOCUMENTS

JP 10-242731 A 9/1998
JP 2003-017916 A 1/2003
(Continued)

OTHER PUBLICATIONS

International Search Report in International Application No. PCT/KR2016/003627, filed Apr. 7, 2016.

*Primary Examiner* — Tho G Phan
(74) *Attorney, Agent, or Firm* — Saliwanchik, Lloyd & Eisenschenk

(57) ABSTRACT

Disclosed is a vehicular antenna. The antenna, according to an embodiment of the present invention, comprises: a spring part which is perpendicularly disposed on the roof of a vehicle; and a metal part perpendicularly disposed on the top of the spring part. The metal part comprises: a first part extending from the body; a second part which extends from the body and is disposed to have a predetermined interval from the first part; and a third part which extends from the body, is disposed between the first and second parts, and is bent to form a predetermined angle with the first and second parts.

8 Claims, 8 Drawing Sheets

(51) Int. Cl.

| | |
|---|---|
| ***H01Q 1/52*** | (2006.01) |
| ***H01Q 9/42*** | (2006.01) |
| ***H01Q 21/24*** | (2006.01) |
| *H01Q 1/08* | (2006.01) |
| *H01Q 1/12* | (2006.01) |
| *H01Q 5/371* | (2015.01) |

(52) U.S. Cl.
CPC ..... *H01Q 21/24* (2013.01); *H01Q 1/085* (2013.01); *H01Q 1/1207* (2013.01); *H01Q 5/371* (2015.01)

(56) References Cited

U.S. PATENT DOCUMENTS

| | | | | |
|---|---|---|---|---|
| 6,653,982 | B2 * | 11/2003 | Lindenmeier ..... | H01Q 7/00 343/741 |
| 7,023,379 | B2 * | 4/2006 | Turnbull ..... | G01S 5/0221 342/357.75 |
| 7,202,826 | B2 * | 4/2007 | Grant ..... | H01Q 1/3275 343/700 MS |
| 9,806,404 | B2 * | 10/2017 | Chakam ..... | H01Q 1/3275 |

FOREIGN PATENT DOCUMENTS

| | | | |
|---|---|---|---|
| KR | 20-2011-0010607 | U | 11/2011 |
| KR | 10-1347936 | B1 | 1/2014 |
| WO | WO-2014/108176 | A1 | 7/2014 |

* cited by examiner

VEHICLE ANTENNA

CROSS-REFERENCE TO RELATED APPLICATIONS

This application is the U.S. national stage application of International Patent Application No. PCT/KR2016/003627, filed Apr. 7, 2016, which claims priority to Korean Application No. 10-2015-0057872, filed Apr. 24, 2015, the disclosures of each of which are incorporated herein by reference in their entirety.

TECHNICAL FIELD

The teachings in accordance with exemplary and non-limiting embodiments of this disclosure relate generally to an antenna on vehicle.

BACKGROUND ART

In general, an AM and FM broadcasting reception antenna mounted at an upper surface of a vehicle is applied with a spring at an upper, a middle or a bottom surface of a dipole antenna, and embedded in a micro-pole antenna or a shark pin antenna. The micro-pole antenna, in particular, is configured in a cylindrical shape where an interior of spring-structured antenna is first filled with plastic injections and rewrapped at an outside with plastic. However, this structure suffers from disadvantages of not performing integrated performances due to not matching to the resonant frequency of antenna if the spring-structured antenna is not positioned at a straight center of extrusion.

Meantime, the shark fin antenna comes in various structures for mass production that is coupled by a spring and various types of metals, but is difficult to improve reception performances over the micro-pole antenna. Furthermore, the micro-pole antenna or the shark fin antenna is disadvantageously difficult or limited in miniaturization.

DETAILED DESCRIPTION OF THE INVENTION

Technical Subject

The exemplary and non-limiting embodiments of this disclosure are provided to solve the aforementioned disadvantages of the prior art, and therefore, the present disclosure is to provide an antenna on vehicle reinforced in performances by reinforcing horizontal and vertical polarization characteristics, as an antenna embedded in a shark fin housing.

Another technical subject is to provide an antenna on vehicle more miniaturized in size and thickness than the conventional shark fin antenna. In the following description, in order to simplify writings, the "antenna in vehicle" is hereinafter referred to as "vehicular antenna".

Technical Solution

In order to solve the technical subject, and in one general aspect of the present disclosure, there is provided a vehicular antenna, comprising:

a spring part vertically arranged on a roof of a vehicle; and a metal part vertically arranged at an upper surface of the spring part, wherein the metal part includes:

a first part formed by being extended from a first body;

a second part formed by being extended from the first body to be spaced apart from the first part at a predetermined distance; and a third part formed by being extended from the first part to be interposed between the first part and the second part and formed by being so bent as to form a predetermined angle with the first and second parts.

Preferably, but not necessarily, the vehicular antenna may further comprise a magnetic substance part at a bottom surface of the metal part.

Preferably, but not necessarily, the vehicular antenna may further comprise a power supply part supplying a current by being disposed at a bottom surface of the spring part, and a transmission part transmitting the current by being interposed between the spring part and the metal part.

Preferably, but not necessarily, the power supply part may include a second body having a diameter corresponding to a diameter of a cross-section of the spring part, a first insertion part formed at one surface of the second body to have a diameter smaller than a diameter of the second body, and a first probe formed at the other surface of the second body to receive a current.

Preferably, but not necessarily, the transmission part may include a third body having a diameter corresponding to a diameter of a cross-section of the spring part, a second insertion part formed at one surface of the third body to have a diameter smaller than a diameter of the third body, and a second probe formed at the other surface of the third body to transmit a current to the metal part.

Preferably, but not necessarily, the metal part may be formed at the first body with a hole corresponding to the second probe.

Preferably, but not necessarily, the third part may be bent in a U shape or a V shape.

In another general aspect of the present disclosure, there is provided a vehicular antenna, comprising:

a first antenna disposed on a roof of a vehicle to receive a signal of a predetermined first band; and a second antenna disposed on a roof of a vehicle to receive a signal of a predetermined second band at a shadow area of the first antenna; wherein the first antenna includes a spring part vertically disposed on a roof of a vehicle, a metal part vertically disposed at an upper surface of the spring part, a magnetic substance part formed at a bottom surface of the metal part, a power supply part disposed at a bottom surface of the spring part to supply a current, and a transmission part interposed between the spring part and the metal part to transmit a current, wherein the metal part includes:

a first part formed by being extended from a body;

a second part formed by being extended from the body to be spaced apart from the first part at a predetermined distance; and a third part formed by being extended from the body to be interposed between the first part and the second part and to be bent at a predetermined angle with the first part and the second part.

Advantageous Effects of the Disclosure

The advantageous effect according to the antenna structure based on an exemplary embodiment of the present disclosure is that reception of horizontal polarization is maximized by a metal part horizontal to a roof of a vehicle, and reception of vertical polarization can be maximized by a third part bent from the metal part at a predetermined angle and a spring part. Furthermore, interference relative to secondary radiation wave generated by a bottom end of an antenna can be cut off by a magnetic substance part and the antenna can be simultaneously miniaturized due to high magnetic permeability, whereby various antennas can be easily installed about the antenna because of light, thin, short and small structure.

BEST MODE

In the following attached drawings, numerous specific details are set forth in order to provide a thorough understanding of the present disclosure. However, this disclosure may be embodied in many different forms and should not be construed as limited to any specific structure or function presented throughout this disclosure. Thus, the disclosure described herein is intended to embrace all such alternatives, modifications, variations and applications as may fall within the spirit and scope of the appended claims.

Now, an exemplary embodiment of the present disclosure will be explained in detail with reference to the accompanying drawings.

Figure 1:
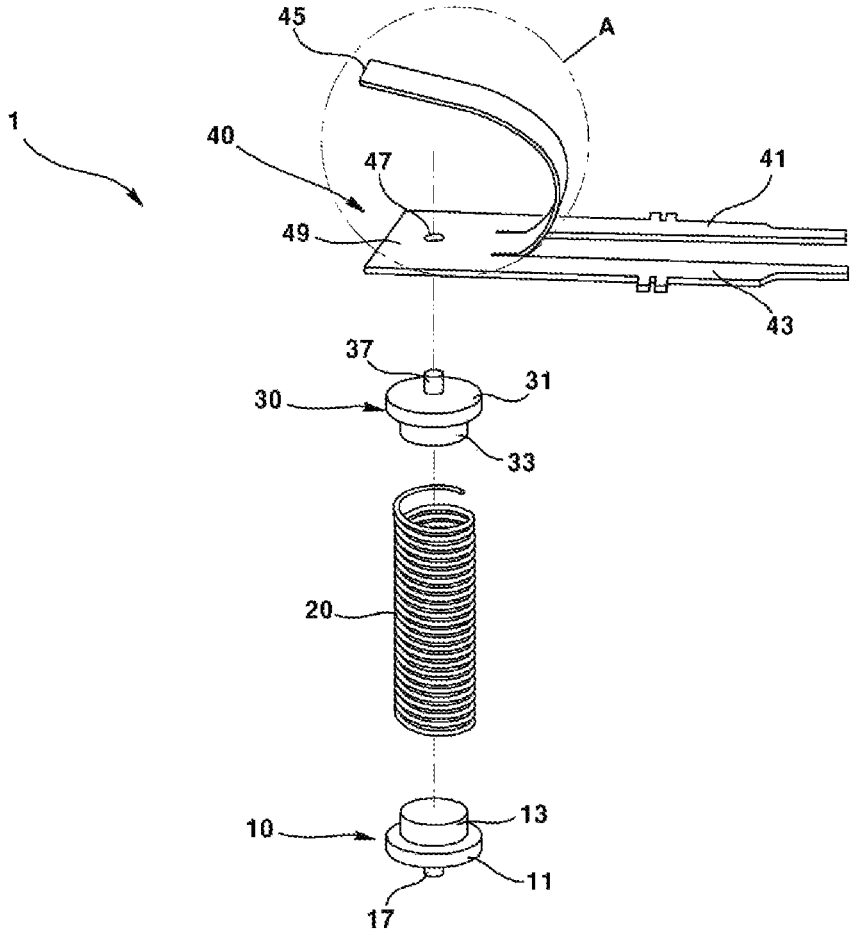
FIG. 1 is an exploded schematic view illustrating a vehicular antenna according to an exemplary embodiment of the present disclosure.
Figure 2:
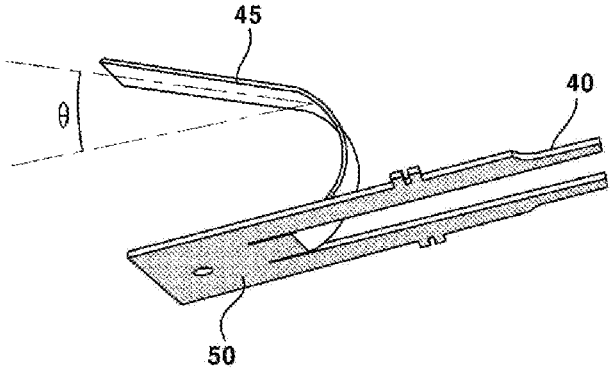
FIG. 2 is an exemplary enlarged view of "A" of FIG. 1.
Figure 3:
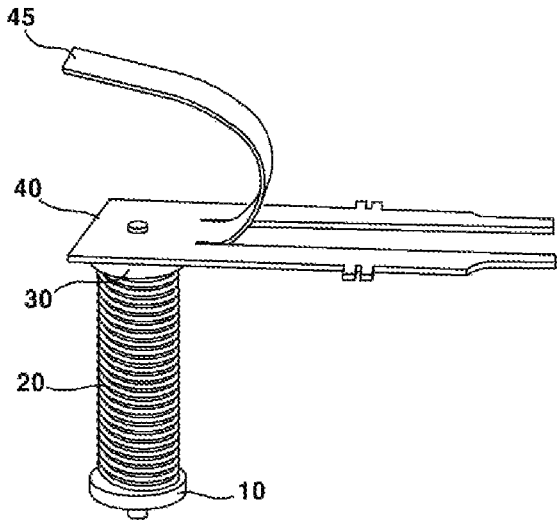
FIG. 3 is an exemplary view of an actually realized vehicular antenna according to an exemplary embodiment of the present disclosure.

FIG. 1 is an exploded schematic view illustrating a vehicular antenna according to an exemplary embodiment of the present disclosure, FIG. 2 is an exemplary enlarged view of "A" of FIG. 1, and FIG. 3 is an exemplary view of an actually realized vehicular antenna according to an exemplary embodiment of the present disclosure.

Referring to FIGS. 1, 2 and 3, a vehicular antenna (1) according to an exemplary embodiment of the present disclosure may include a power supply part (10), a spring part (20), a current transmission part (30), a metal part (40) and a magnetic substance part (50), and may be formed inside a shark antenna. At this time, the spring part (20) may be vertically disposed on a roof (2) of a vehicle, and the metal part (40) may be vertically formed at the spring part (20). The power supply part (10) may supply a power to the vehicular antenna (1). That is, the power supply part (10) may supply a current necessary for radiation of a signal by being coupled to the spring part (20).

The spring part (20) may be coupled to the metal part (40) through the current transmission part (30), or may be directly coupled to the magnetic substance part (50) formed at a bottom surface of the metal part (40) to form an antenna for broadcasting reception. The magnetic substance part (50) may be disposed at a bottom surface of the metal part (40), and when the magnetic substance part (50) is installed on a vehicle, interference relative to secondary radiation wave generated from a bottom surface of a shark fin antenna can be prevented, and size of an overall antenna can simultaneously be miniaturized due to high magnetic permeability to allow having a further excellent reception performance.

The magnetic substance forming the magnetic substance part (50) includes a material having magnetism and may be formed with various materials, and the metal part (40) may be coated at one surface with a magnetic substance material, for example. However, this is exemplary and the present disclosure is not limited thereto. The metal part (40) may be adhered with film-type magnetic substance material through an adhesive agent, and the magnetic substance materials may be formed at a bottom surface with various shapes.

The metal part (40) may be formed by a structure for reinforcing horizontal and vertical polarization reception performances. That is, as illustrated in the drawings, the metal part (40) according to an exemplary embodiment of the present disclosure may be formed by being extended from a body (49), and may include a first part (41), a second part (43), each being parallel, and a third part disposed between the first and second parts (41, 43), where the third part (45) may be formed by being so bent as to form a predetermined angle with the first and second parts (41, 43). At this time, the third part (45) may be bent in a V shape from the first and second parts (41, 43), or may be bent in a V shape. Thus, the horizontal and vertical polarization reception performances can be reinforced by this structure, which will be further explained through the drawings.

The power supply part (10) according to an exemplary embodiment of the present disclosure may be formed by including a body (11) having a diameter corresponding to a diameter of a cross-section of the spring part (20), an insertion part (13) formed at one surface of the body (11) to have a diameter smaller than a diameter of the body (11), and a probe (17) formed at the other surface of the body (11) to receive a current. The insertion part (13) can be inserted into the spring part (20) because the insertion part (13) has a diameter smaller than a diameter of the spring part (20).

The transmission part (30) according to an exemplary embodiment of the present disclosure may be formed by including a body (31) having a diameter corresponding to a diameter of a cross-section of the spring part (20), an insertion part (33) formed at one surface of the body (11) to have a diameter smaller than a diameter of the body (31), and a probe (37) formed at the other surface of the body (31) to transmit a current to the metal part (40). according to an exemplary embodiment of the present disclosure may be formed by including a body (11) having a diameter corresponding to a diameter of a cross-section of the spring part (20), an insertion part (13) formed at one surface of the body (11) to have a diameter smaller than a diameter of the body (11), and a probe (17) formed at the other surface of the body (11) to receive a current. The insertion part (33) can be inserted into the spring part (20) because the insertion part (33) has a diameter smaller than a diameter of the spring part (20). Furthermore, a body (49) of the metal part (40) may be formed with a hole (47) corresponding to the probe (37).

The current applied from the probe (17) of the power supply part (10) may be transmitted to the current transmission part (30) through the spring part (20), and may be transmitted to the metal part (40) through the probe (37) of the current transmission part (30). Furthermore, a signal applied through the metal part (40) may be transmitted in a reverse direction.

Figure 4A:
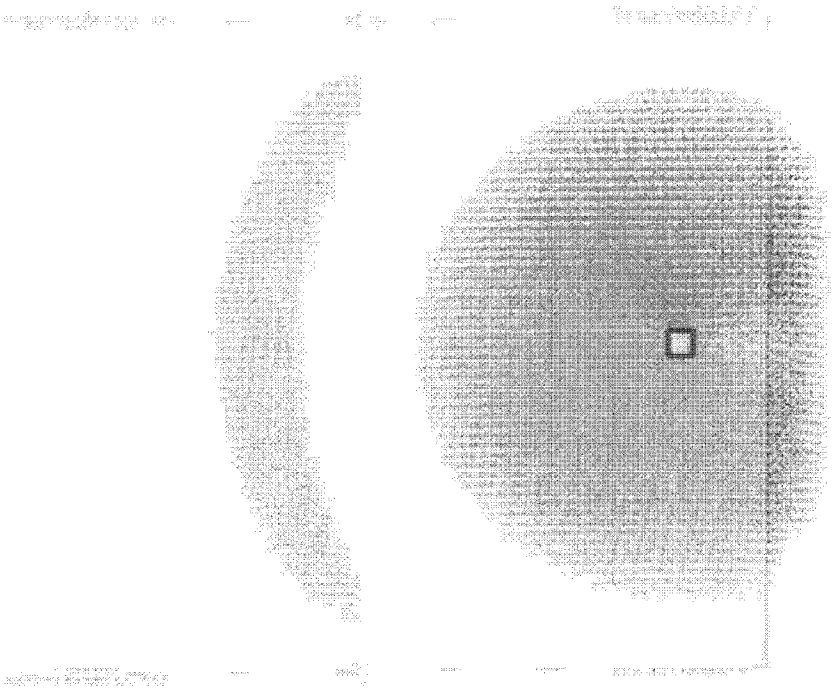
FIGS. 4*a* and 4*b* are exemplary views illustrating a horizontal polarization reception rate of a vehicular antenna according to an exemplary embodiment of the present disclosure.
Figure 4B:
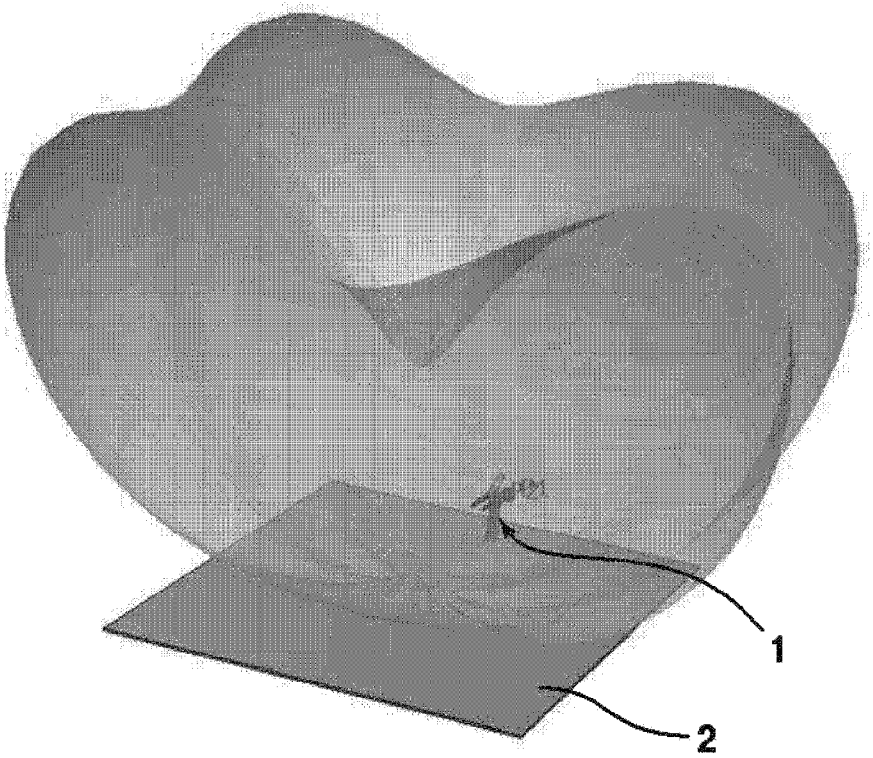

FIGS. 4*a* and 4*b* are exemplary views illustrating a horizontal polarization reception rate of a vehicular antenna according to an exemplary embodiment of the present disclosure.

When a current is transmitted to an E-field which is a horizontal surface, as illustrated in FIG. 4*a*, a radiation pattern may be formed, as shown in FIG. 4*b*, by the metal part (40) of the vehicular antenna (1) according to the present disclosure, whereby it can be learned that the horizontal polarization reception rate can be maximized.

Figure 5A:
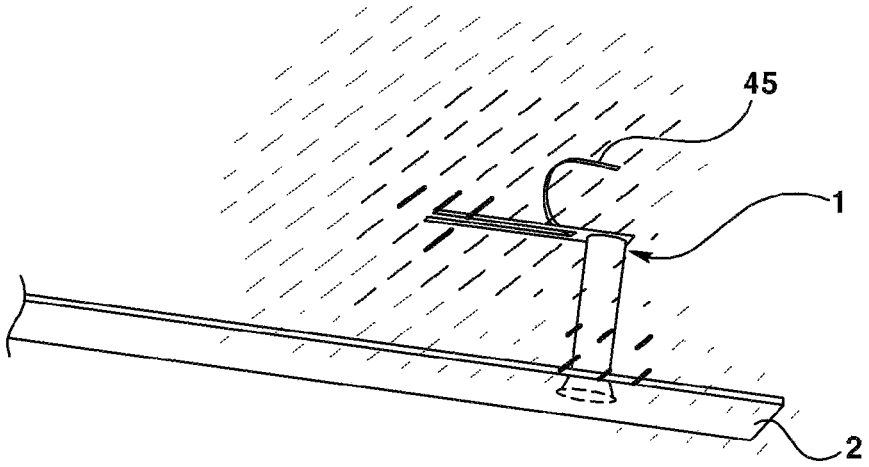
FIGS. 5*a* and 5*b* are exemplary views illustrating a vertical polarization reception rate of a vehicular antenna according to an exemplary embodiment of the present disclosure.
Figure 5B:
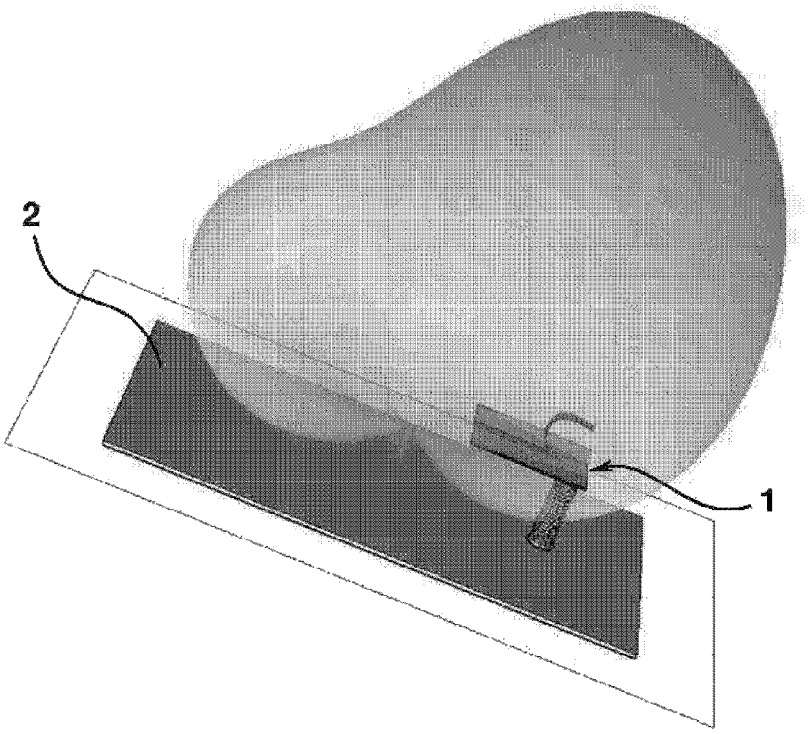

FIGS. 5*a* and 5*b* are exemplary views illustrating a vertical polarization reception rate of a vehicular antenna according to an exemplary embodiment of the present disclosure.

As shown in FIG. 5*a*, a current is vertically formed to an H-field by the spring part (20) vertical from the horizontal surface and a predetermined angle formed by the third part (45) of the metal part (40) with the horizontal surface, whereby a radiation pattern is formed as shown in FIG. 5*b* to thereby maximize a vertical polarization reception rate.

Figure 6A:
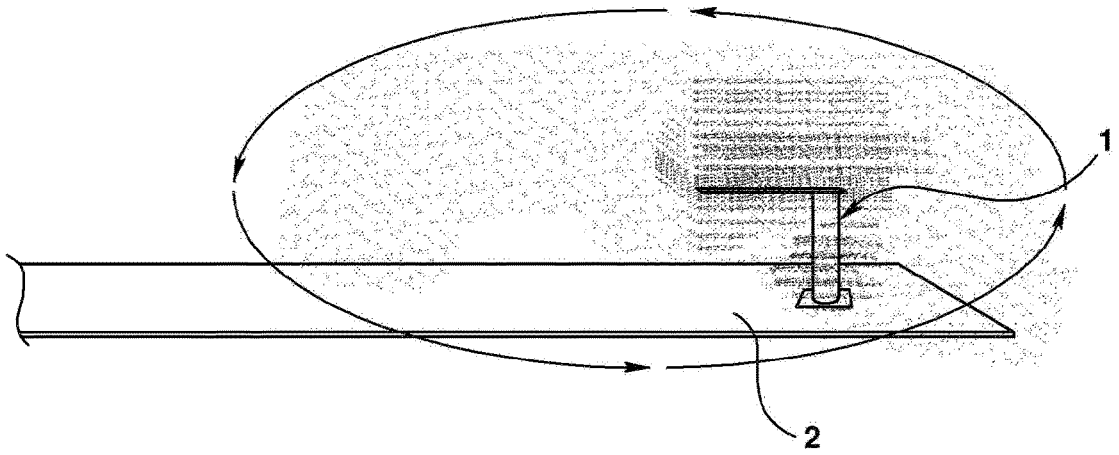
FIGS. 6*a* and 6*b* are exemplary views illustrating horizontal and vertical polarization reception rates of a vehicular antenna according to an exemplary embodiment of the present disclosure.
Figure 6B:
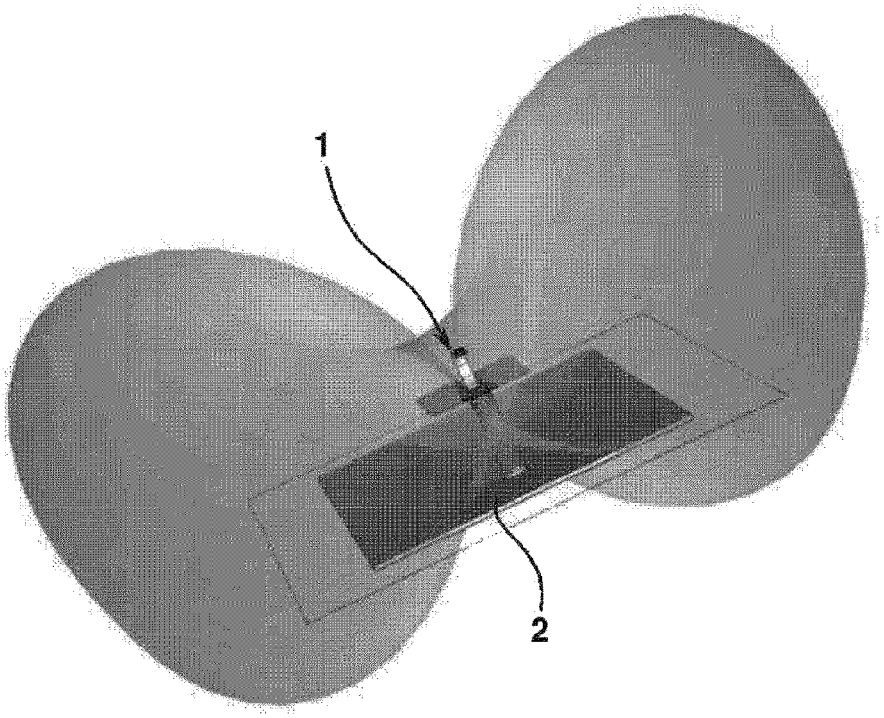

FIGS. 6*a* and 6*b* are exemplary views illustrating horizontal and vertical polarization reception rates of a vehicular antenna according to an exemplary embodiment of the present disclosure.

That is, as discussed above, the E-field and the H-field are mutually coupled and a current is vertically and horizontally formed and rotated across a roof (2) of the vehicle as illustrated in FIG. 6*a*, whereby a radiation is realized as shown in FIG. 6*b* to thereby maximize the reception performance.

Figure 7:
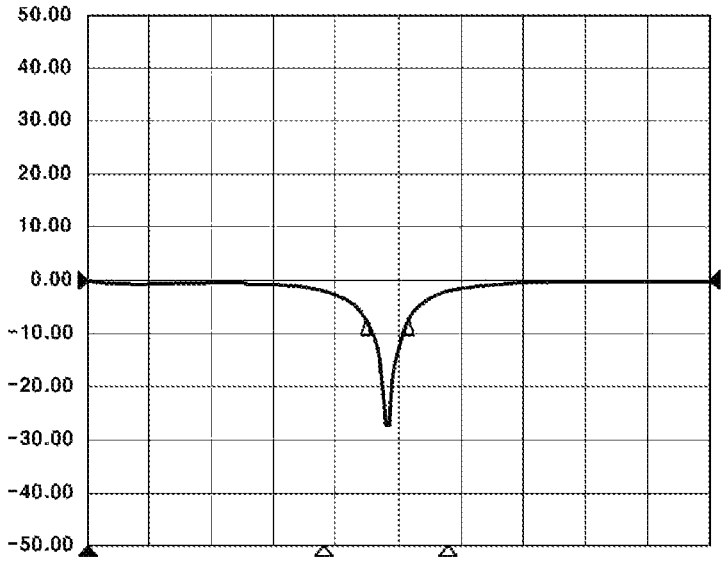
FIG. 7 is an exemplary view illustrating a resonant characteristic of a vehicular antenna of the present disclosure.

FIG. 7 is an exemplary view illustrating a resonant characteristic of a vehicular antenna of the present disclosure. It can be noted from FIG. 7 that resonance is realized in AM and FM frequency antennas.

Figure 8A:
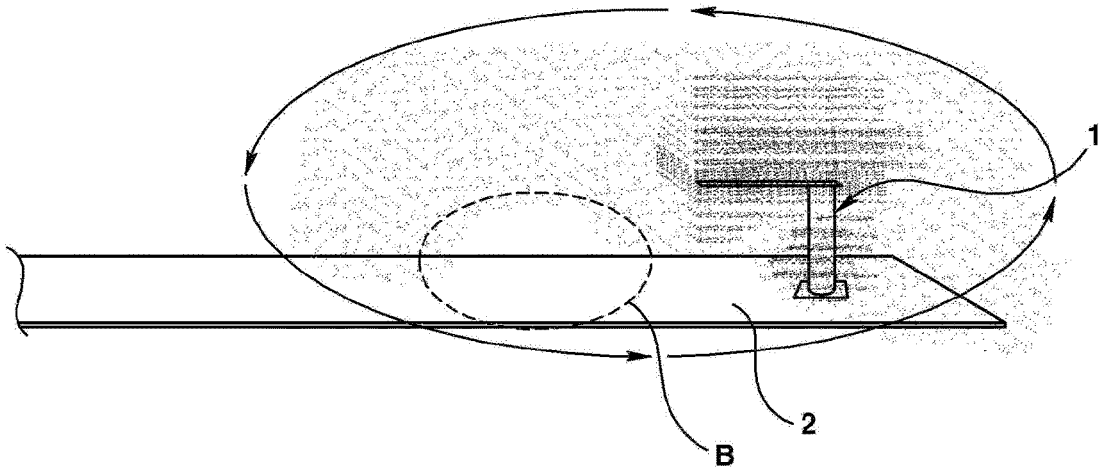
FIG. 8*a* is an exemplary view illustrating an example of a vehicular antenna mounted on a vehicle according to an exemplary embodiment of the present disclosure.

FIG. 8*a* is an exemplary view illustrating an example of a vehicular antenna mounted on a vehicle according to an exemplary embodiment of the present disclosure. However, it should be noted that this is exemplary only and therefore, a housing of a shark fin antenna can be formed at an outside of the vehicular antenna. As shown the drawing, the vehicular antenna (1) of the present disclosure is arranged on a roof (2) of a vehicle, and it can be noted that a shadow area like "B" can be generated when radiation is performed from the vehicular antenna (1). Thus, an antenna having a different frequency band can be installed at the shadow area according to an exemplary embodiment of the present disclosure.

Figure 8B:
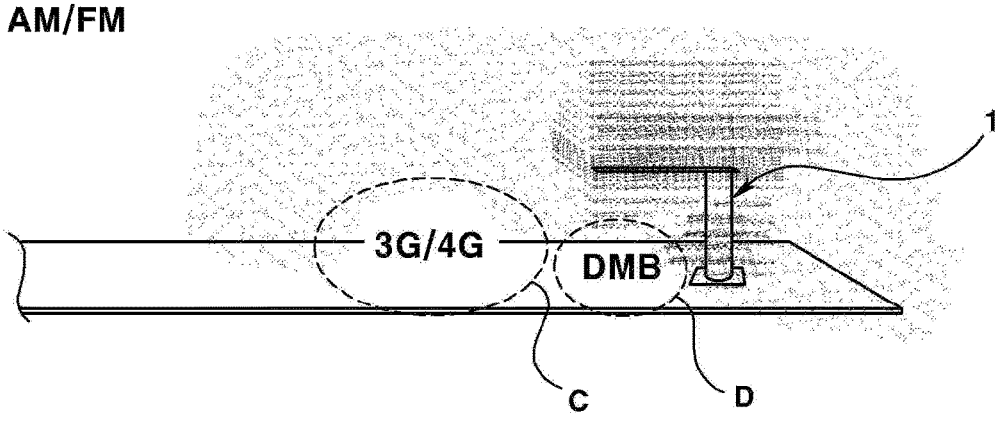
FIG. 8*b* is an exemplary view illustrating an antenna of various bands mounted at a shadow area of a vehicular antenna according to the present disclosure.

FIG. 8*b* is an exemplary view illustrating an antenna of various bands mounted at a shadow area of a vehicular antenna according to the present disclosure.

Referring to FIG. 8*b*, an antenna (not shown) for mobile communication may be disposed at a "C" area on a shadow area of the vehicular antenna (1) for broadcasting reception according to an exemplary embodiment of the present disclosure, or an antenna (not shown) for DMB (Digital Multimedia Broadcasting) may be arranged at a "D" area. However, this is an exemplary purpose and the present disclosure is not limited thereto. An antenna for reception of various signals may be arranged at a shadow area of the vehicular antenna.

According to the antenna structure discussed above, reception of horizontal polarization can be maximized by the metal part (40) arranged in a horizontal manner on a roof of a vehicle, and vertical polarization reception can be maximized by the third part (45) bent at a predetermined angle from the metal part (40) and the spring part (40). Furthermore, interference relative to the secondary radiation wave generated from a bottom end of the antenna can be cut off by the magnetic substance part (50) and an antenna can be miniaturized because of high magnetic permeability.

Although the abovementioned embodiments according to the present disclosure have been described in detail with reference to the above specific examples, the embodiments are, however, intended to be illustrative only, and thereby do not limit the scope of protection of the present disclosure. Thereby, it should be appreciated by the skilled in the art that changes, modifications and amendments to the above examples may be made without deviating from the scope of protection of the disclosure.

The invention claimed is:

1. A vehicular antenna, comprising:

a spring part vertically arranged on a roof of a vehicle; and a metal part vertically arranged at an upper surface of the spring part, wherein the metal part includes:

a first part formed by being extended from a first body;

a second part formed by being extended from the first body to be spaced apart from the first part at a predetermined distance; and a third part formed by being extended from the first body to be interposed between the first part and the second part and formed by being so bent as to form a predetermined angle with the first and second parts.

2. The vehicular antenna of claim 1, further comprising a magnetic substance part at a bottom surface of the metal part.

3. The vehicular antenna of claim 1, further comprising a power supply part supplying a current by being disposed at a bottom surface of the spring part, and a transmission part transmitting the current by being interposed between the spring part and the metal part.

4. The vehicular antenna of claim 3, wherein the power supply part includes a second body having a diameter corresponding to a diameter of a cross-section of the spring part, a first insertion part formed at one surface of the second body to have a diameter smaller than the diameter of the second body, and a first probe formed at the other surface of the second body to receive a current.

5. The vehicular antenna of claim 3, wherein the transmission part includes a third body having a diameter corresponding to a diameter of a cross-section of the spring part, a second insertion part formed at one surface of the third body to have a diameter smaller than the diameter of the third body, and a second probe formed at the other surface of the third body to transmit a current to the metal part.

6. The vehicular antenna of claim 5, wherein the metal part is formed at the first body with a hole corresponding to the second probe.

7. The vehicular antenna of claim 1, wherein the third part is bent in a U shape or a V shape.

8. A vehicular antenna, comprising:

a first antenna disposed on a roof of a vehicle to receive a signal of a predetermined first band; and a second antenna disposed on the roof of the vehicle to receive a signal of a predetermined second band at a shadow area of the first antenna; wherein the first antenna includes a spring part vertically disposed on the roof of the vehicle, a metal part vertically disposed at an upper surface of the spring part, a magnetic substance part formed at a bottom surface of the metal part, a power supply part disposed at a bottom surface of the spring part to supply a current, and a transmission part interposed between the spring part and the metal part to transmit a current, wherein the metal part includes:

a first part formed by being extended from a body;

a second part formed by being extended from the body to be spaced apart from the first part at a predetermined distance; and a third part formed by being extended from the body to be interposed between the first part and the second part and to be bent at a predetermined angle with the first part and the second part.

* * * * *